US010030411B2

(12) United States Patent
Coleman et al.

(10) Patent No.: US 10,030,411 B2
(45) Date of Patent: Jul. 24, 2018

(54) WINDSTORM DAMPER DEVICE

(71) Applicant: SCHLAGE LOCK COMPANY LLC, Indianapolis, IN (US)

(72) Inventors: Michael D. Coleman, Noblesville, IN (US); John Snodgrass, Indianapolis, IN (US); Ryan D. Hartman, Huntersville, NC (US)

(73) Assignee: Schlage Lock Company LLC, Carmel, IN (US)

( * ) Notice: Subject to any disclaimer, the term of this patent is extended or adjusted under 35 U.S.C. 154(b) by 586 days.

(21) Appl. No.: 14/522,293

(22) Filed: Oct. 23, 2014

(65) Prior Publication Data

US 2016/0115719 A1 Apr. 28, 2016

(51) Int. Cl.
*E05B 65/10* (2006.01)
*E05B 17/00* (2006.01)
(Continued)

(52) U.S. Cl.
CPC ..... *E05B 17/0041* (2013.01); *E05B 17/002* (2013.01); *E05B 17/2084* (2013.01); *E05B 65/1053* (2013.01); *E05B 2015/0482* (2013.01)

(58) Field of Classification Search
CPC .. E05B 65/10; E05B 65/1046; E05B 65/1053; E05B 65/1006; E05B 65/106; E05B 65/1066; E05B 65/1073; E05B 15/04; E05B 17/0041; E05B 15/0413; E05B 15/0093; E05B 17/002; E05B 17/2084; E05B 2015/0482; E05B 65/1093; E05C 1/14; E05C 3/162; Y10T 292/0908;
(Continued)

(56) References Cited

U.S. PATENT DOCUMENTS 4,167,280 A * 9/1979 Godec ..... E05B 65/1053 292/21
5,011,199 A * 4/1991 Lowe ..... E05B 47/0002 292/92
(Continued)

FOREIGN PATENT DOCUMENTS

CA 2309494 A1 * 11/2000 ..... E05B 17/2084
EP 0233094 A1 * 8/1987 ..... E05B 47/0657
(Continued)

*Primary Examiner* — Christine M Mills
(74) *Attorney, Agent, or Firm* — Taft Stettinius & Hollister LLP

(57) ABSTRACT

A damping device for an exit device that is configured to resist high velocity movement a latch assembly relative to a baseplate assembly. Pivotal displacement of a bell crank during typical operation of the exit device may cause a protrusion of the bell crank to exert a pulling force on control linkage element that is coupled to a connection link of a latch assembly and a spring damper element of the damper device, thereby operating the latch assembly while also generally by-passing the damping effect of the damping device. When high velocity movement is imparted on an entryway device associated with the exit device, the damper device resists high velocity movement of the latch assembly relative to the baseplate assembly, thereby at least attempting to prevent the latch assembly from moving independently of the baseplate assembly so as to prevent unlatching of a latch of the latch assembly.

20 Claims, 7 Drawing Sheets

(51) Int. Cl.
*E05B 17/20* (2006.01)
*E05B 15/04* (2006.01)

(58) Field of Classification Search
CPC ..... Y10T 292/0909; Y10T 292/091; Y10T 292/1075; Y10T 70/5159; Y10S 292/65; Y10S 292/22; Y10S 292/73
USPC ..... 292/92–94, 195, DIG. 65, DIG. 22; 70/92
See application file for complete search history.

(56) References Cited

U.S. PATENT DOCUMENTS 5,067,757 A * 11/1991 Cohrs ..... E05B 17/0041 292/336.3
5,085,475 A * 2/1992 Austin ..... E05B 65/1093 292/144
5,865,481 A 2/1999 Buschmann
6,009,732 A * 1/2000 Haeck ..... E05B 17/06 292/92
6,199,922 B1 3/2001 Kibble
6,409,232 B1 6/2002 Nigro, Jr. et al.
6,532,777 B2 3/2003 Haeck et al.
6,779,819 B2 * 8/2004 Surko, Jr. ..... E05B 65/1073 292/172
6,854,773 B2 * 2/2005 Lin ..... E05B 65/104 292/92
7,905,522 B1 * 3/2011 Picard ..... E05B 13/002 292/92
8,042,843 B2 * 10/2011 Tien ..... E05B 65/1053 292/92
8,424,929 B2 4/2013 Baragaño Gonzalez
2010/0026012 A1 * 2/2010 Lin ..... E05B 65/1053 292/92
2012/0032455 A1 * 2/2012 Lin ..... E05B 17/0041 292/92
2013/0001960 A1 * 1/2013 Tien ..... E05B 17/2003 292/96

FOREIGN PATENT DOCUMENTS

EP 0481931 A1 * 4/1992 ..... E05B 65/1053
EP 1050642 A2 * 11/2000 ..... E05B 65/1053
EP 1063375 B1 9/2003

* cited by examiner

WINDSTORM DAMPER DEVICE

BACKGROUND

The present invention generally relates to exit devices, and more specifically to an exit device that is adapted to retain the exit device in a locked condition during at least relatively high impact force situations.

During windstorms, including, for example, during tornado or hurricane events, entryway devices, such as doors and gates, among other devices, may be subjected to relatively high impact forces. Moreover, during windstorms, flying debris and other objects may strike entryway devices with sufficient impact force(s) to facilitate the unintentional unlatching of an associated exit device of the entryway device. For example, in certain instances, such an impact force(s) may cause the entryway device to flex inward while a push pad of the exit device remains relatively stationary. The resulting relative compression of the push pad may activate the exit device, causing the associated latches of the exit device to be displaced from a locked position to an unlocked position.

In at least an attempt to resist such compression, some exit devices use stiffer action rod springs. However, during at least normal operation of the exit device, stiffer action rod springs may increase the force that is needed to be exerted against the push pad to compress the push pad to operate the exit device, which may adversely impact the everyday ease of usage of the exit device. Further, even with stiffer action rod springs, the impulse nature of impact force(s) against the entryway device, such as, impact forces associated with hurricane events, may generate enough velocity in the push pad and connection system of the exit device to create a momentum that causes that a portion of the exit device to move independently of another portion of the exit device, such as, for example, a baseplate moving assembly, and thereby cause activation of the exit device so that the latch(es) is/are released from the locked position.

BRIEF SUMMARY

An aspect of the present invention is an exit device comprising at least one bell crank having a protrusion, the at least one bell crank being configured for pivotal displacement from a first, uncompressed position, to a second, compressed position. The exit device further includes a control linkage element that has a first end and a second end, the second end having an aperture sized to receive slideable displacement of the protrusion. Additionally, the exit device includes a latch assembly having a connection link and a latch, the connection link being coupled to the first end of the control linkage. The exit device further includes a spring damper element that is coupled to the control linkage element and which is configured to resist high velocity movement of the connection link independent of movement of the at least one bell crank.

Another aspect of the present invention is a baseplate assembly for connection to at least a connection link of a latch assembly. The baseplate assembly includes a baseplate having a first end and a second end and a bell crank having a first side. The first side of the bell crank is pivotally coupled to a first side plate that is operably connected to the baseplate. Additionally, the first side has a first protrusion. The baseplate assembly further includes a first control linkage element having a first end and a second end, the first end having a first aperture that is configured to be coupled to a connection link of a latch assembly. The second end of the control linkage element has a second aperture that is configured to receive slideable displacement of the first protrusion. The baseplate assembly also includes a spring damper element that is coupled to the first control linkage element and which is configured to resist high velocity movement of the connection link independent of movement of the at least one bell crank.

A further aspect of the present invention is a baseplate assembly for connection to at least a connection link of a latch assembly. The baseplate assembly includes a baseplate having a first end and a second end and a bell crank having a first side and a second side. The first side of the bell crank has a first protrusion and is pivotally coupled to a first side plate. Additionally, the second side of the bell crank has a second protrusion and is pivotally coupled to a second side plate, with the first and second side plates being operably connected to the baseplate. The baseplate assembly also includes a spring damper element that is coupled to the first and second control linkage elements. The spring damper element is configured to resist high velocity movement of the connection link independent of movement of the latch assembly.

Figure 1:
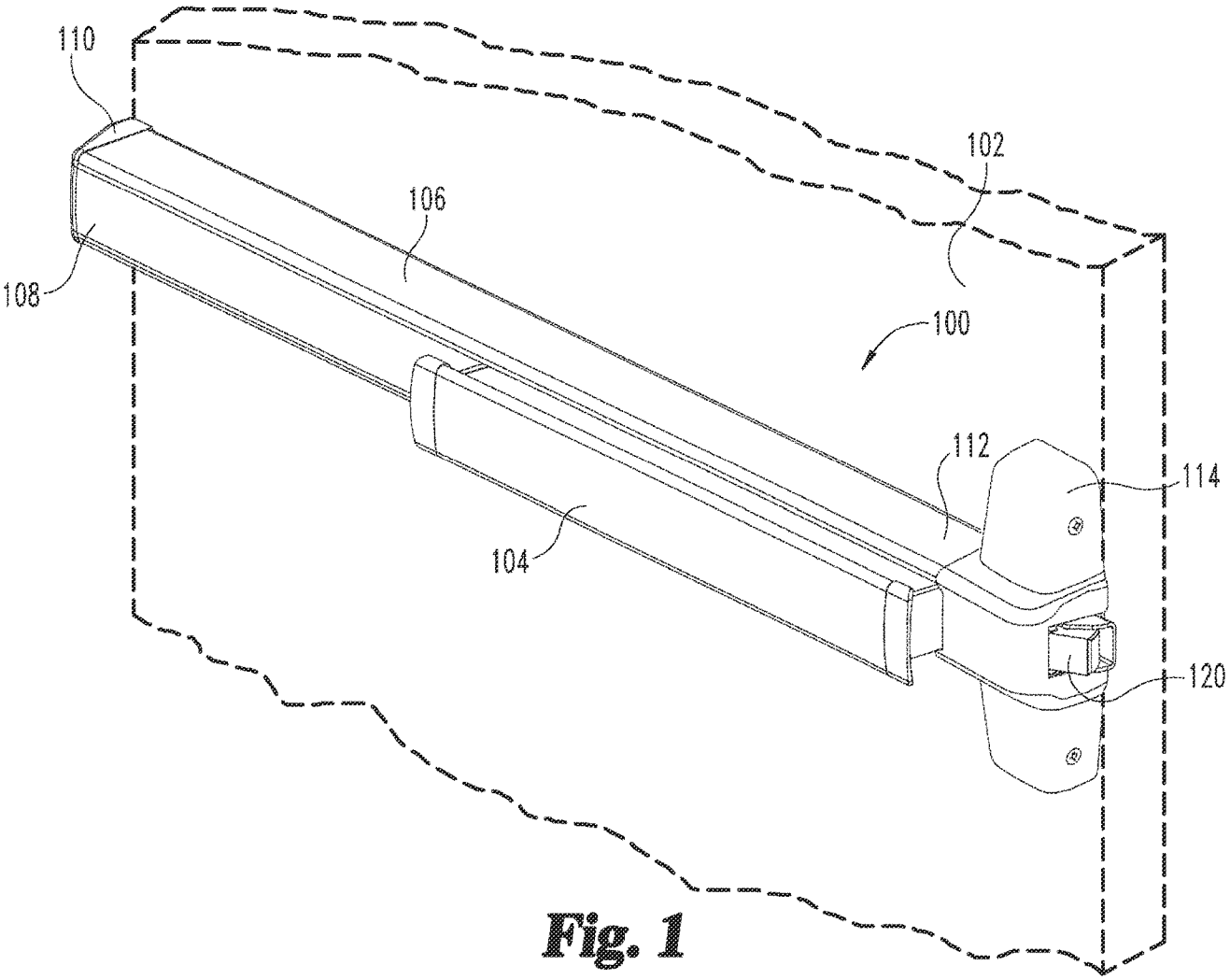
FIG. 1 illustrates a front side perspective view of an exit device operably attached to an entryway device according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

Figure 2:
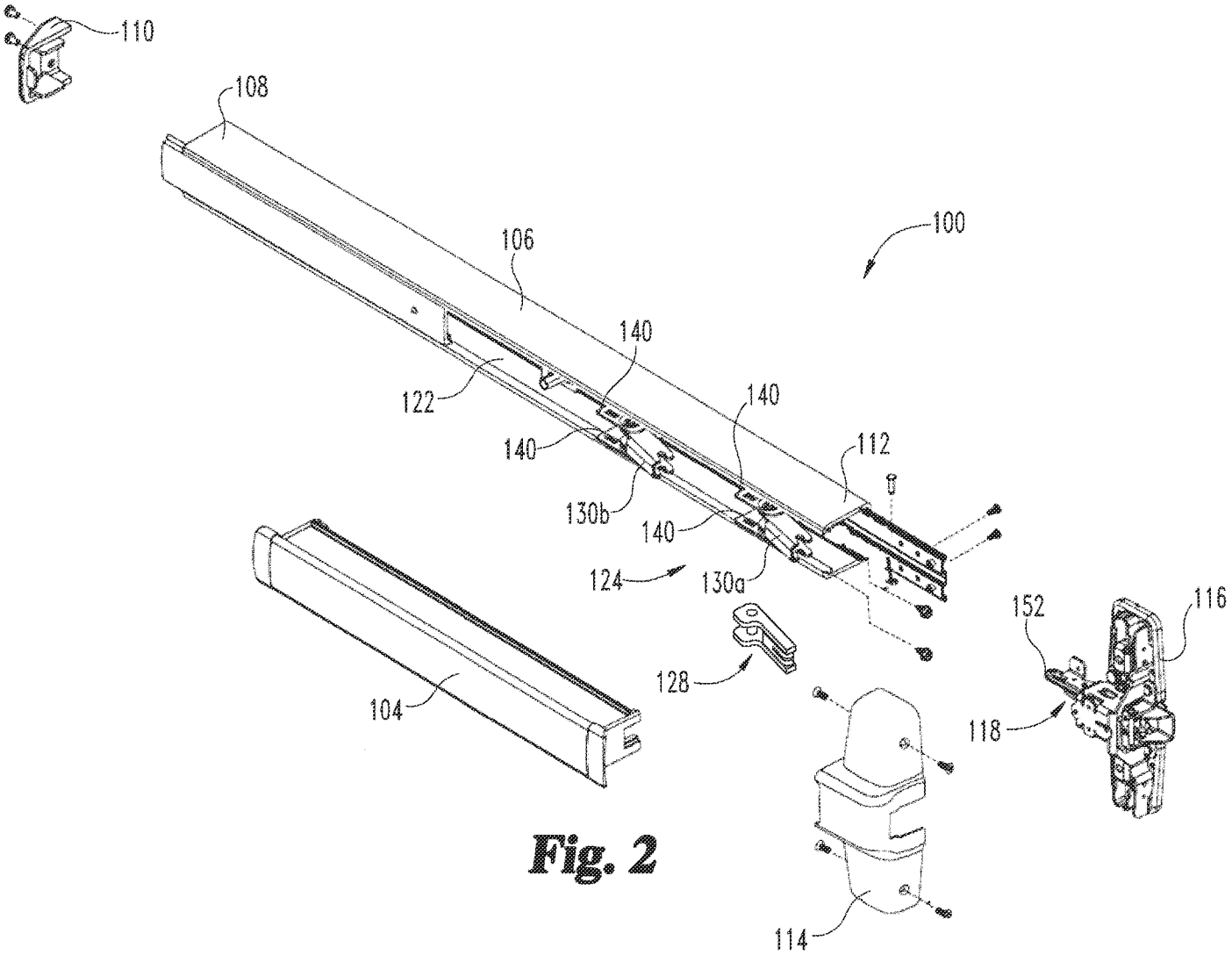
FIG. 2 illustrates an exploded view of an exit device according to an embodiment of the present invention.

FIGS. 1 and 2 illustrate front side perspective and exploded views, respectively, of an exit device 100 that is adapted to be operably attached to an entryway device 102, such as, for example, a door or gate, according to an embodiment of the present invention. According to the depicted embodiment, the exit device 100 includes a push bar 104 that may extend from a mechanism case 106. The mechanism case 106 may be directly or indirectly connected to the entryway device 102, such as, for example, by one or more mechanical fasteners, including, screws, bolts, and/or pins, among other connections. A distal end 108 of the mechanism case 106 may be secured to an end cap 110, while a proximal end 112 of the mechanism case 106 may be operably secured to a centercase cover 114. The centercase cover 114 may house at least a portion of centercase assembly 116 that includes a latch assembly 118 having a latch 120. The latch assembly 118 is operable connected to the push bar 104 such that, during typical everyday usage, the operable displacement of the push bar 104 generally toward the mechanism case 106 may operate the latch assembly 118 such that the latch 120 may be displaced from a locked position to an unlocked position, thereby allowing opening of a closed entryway device 102.

Figure 3:
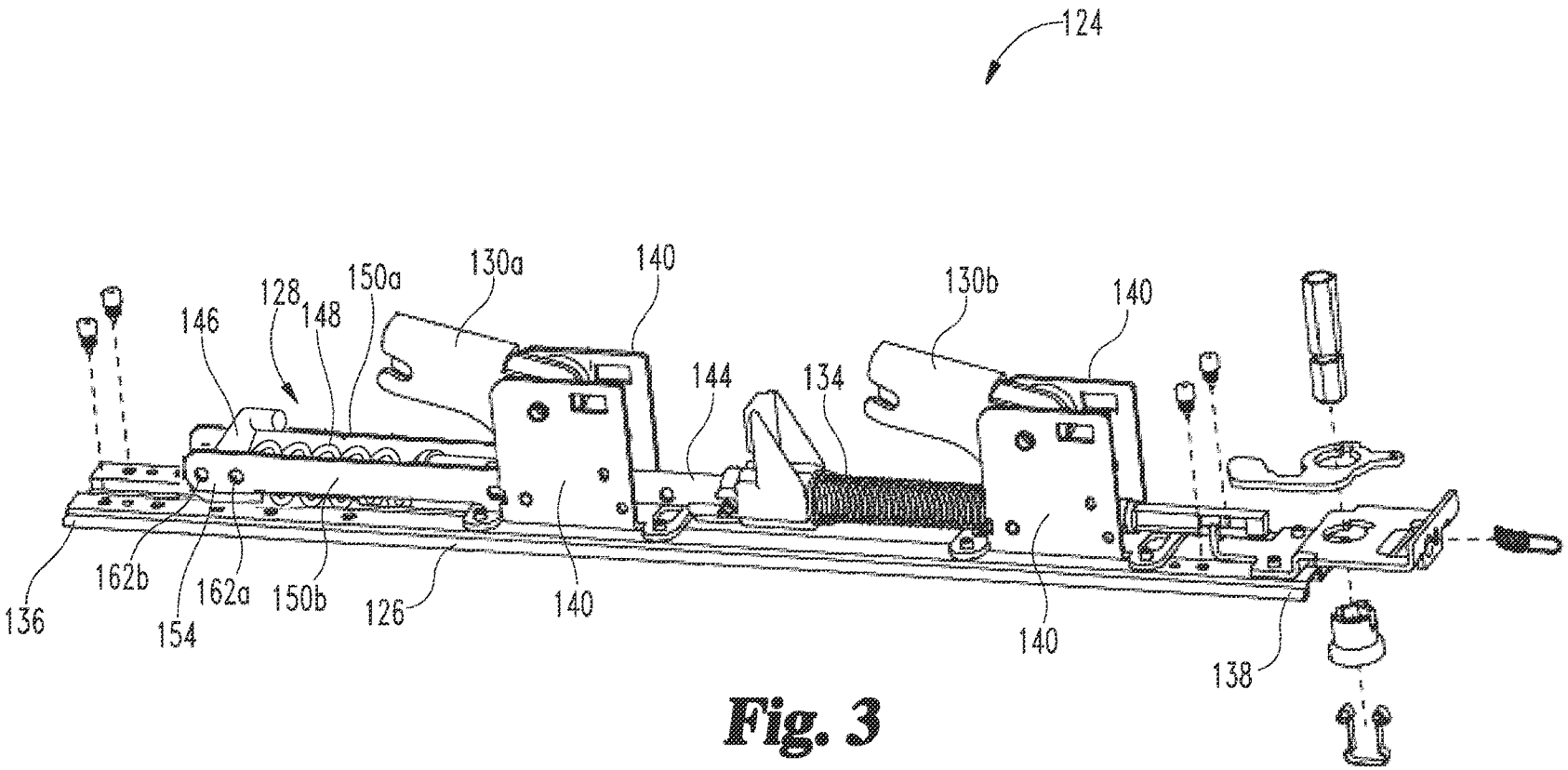
FIG. 3 illustrates a perspective view of a baseplate assembly having a damper device according to an illustrated embodiment of the present invention.
Figure 4:
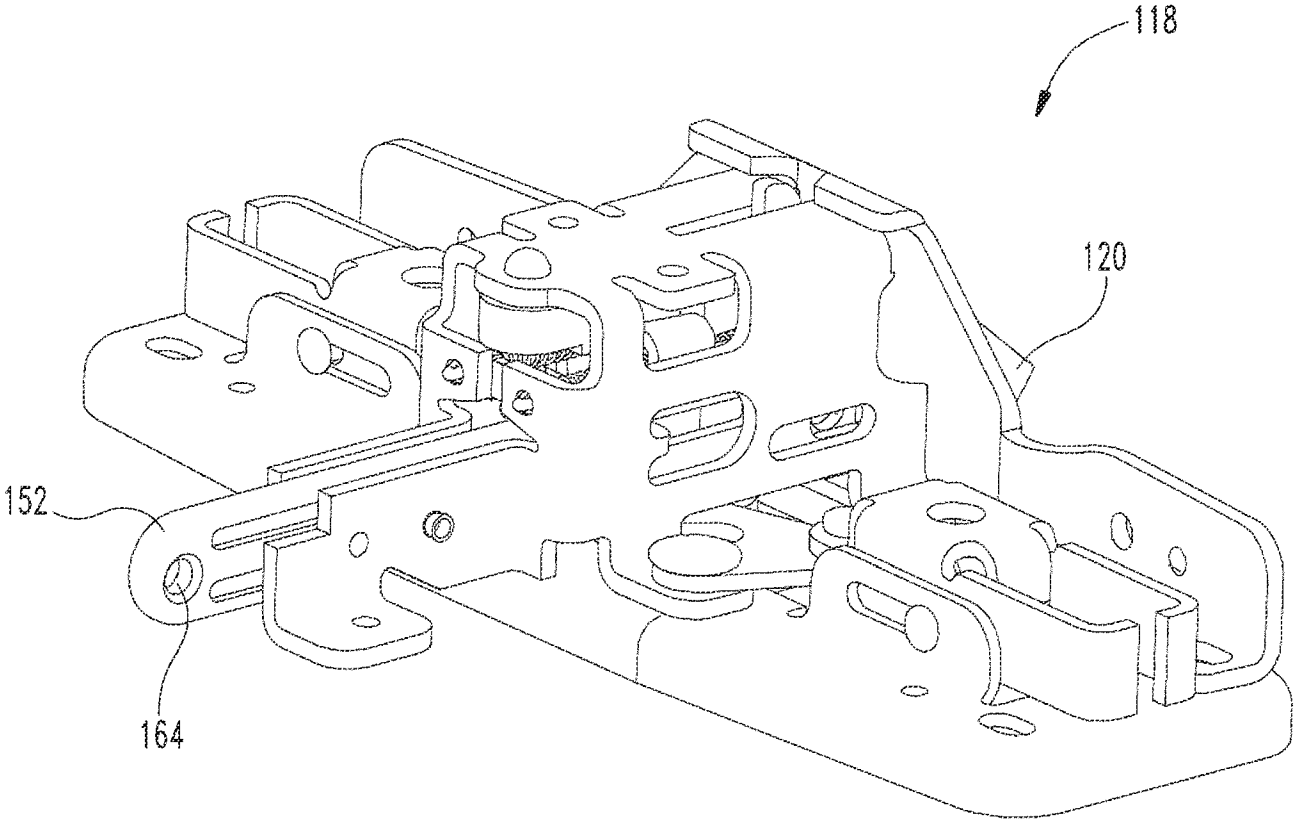
FIG. 4 illustrates a perspective view of a center case assembly having a latch assembly according to an illustrated embodiment of the present invention.

Referencing FIGS. 2 and 3, an interior portion 122 of the exit device 100 houses at least a portion of a baseplate assembly 124 of the exit device 100. According to certain embodiments, the baseplate assembly 124 includes a baseplate 126, a damper device 128, at least one bell crank 130*a*, 130*b*, a shock shaft 144, and one or more biasing elements 134. The baseplate 126 has a first end 136 and a second end 138, and may be configured to be coupled to the mechanism case 106, such as, for example, via one or more mechanical fasteners, including, for example, screws, bolts, pin, and rivets, among other manners of attachment. The bell cranks 130*a*, 130*b* may be pivotally secured to one or more side plates 140 that extend from the baseplate 126, with the side plates 140 being operably secured to the baseplate 126, such as, for example, via one or more mechanical fasteners.

Figure 5:
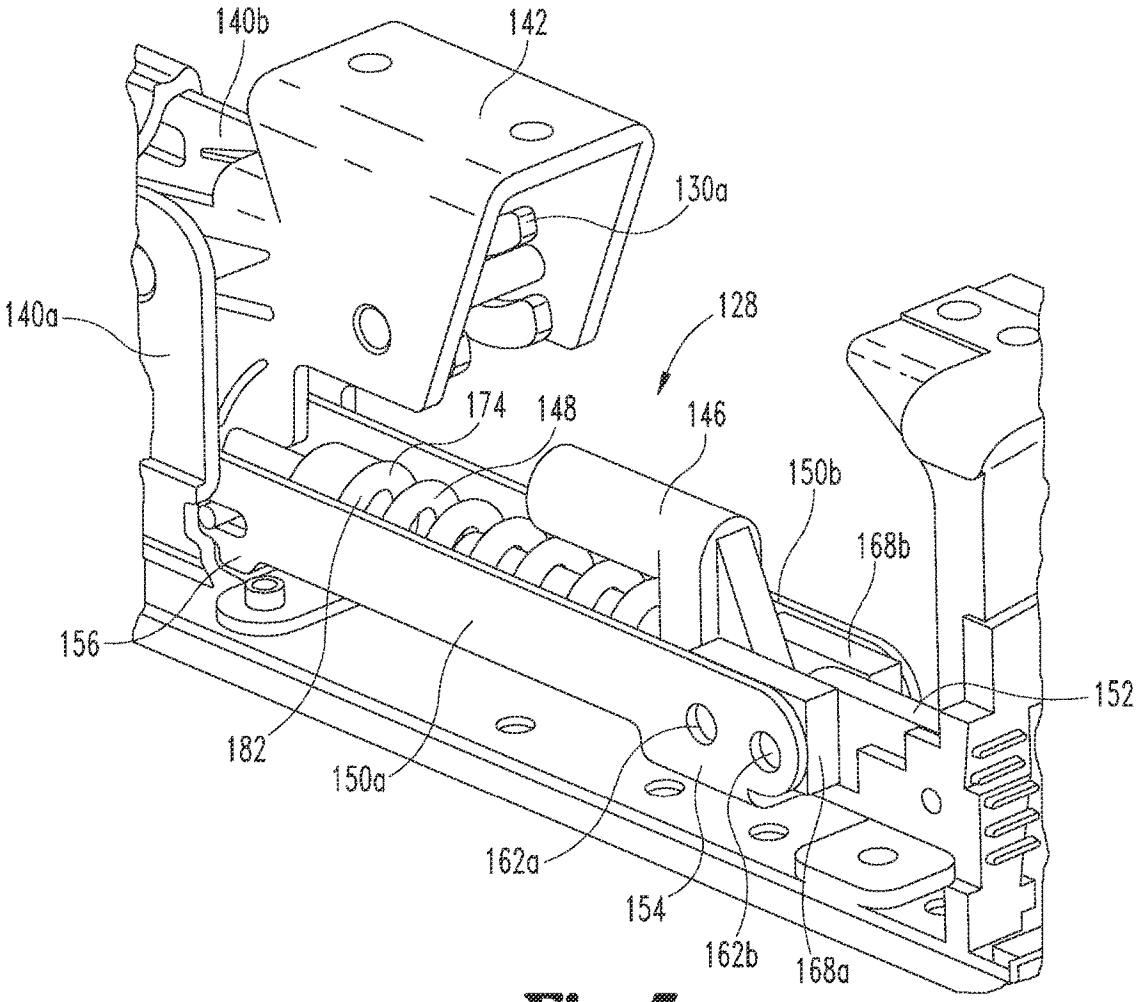
FIG. 5 illustrates a top perspective view of a portion of a baseplate assembly having a damper device according to an illustrated embodiment of the present invention.
Figure 6:
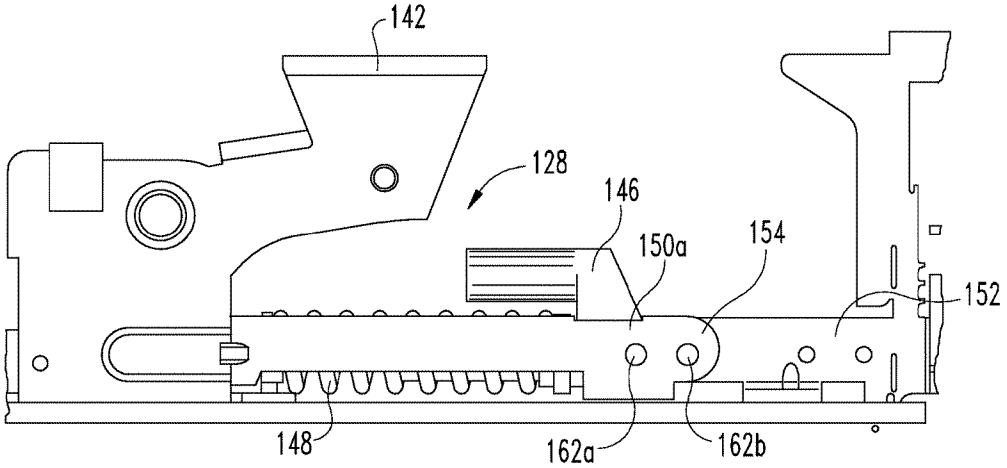
FIG. 6 illustrates a top view of a portion of the baseplate assembly shown in FIG. 5.
Figure 7:
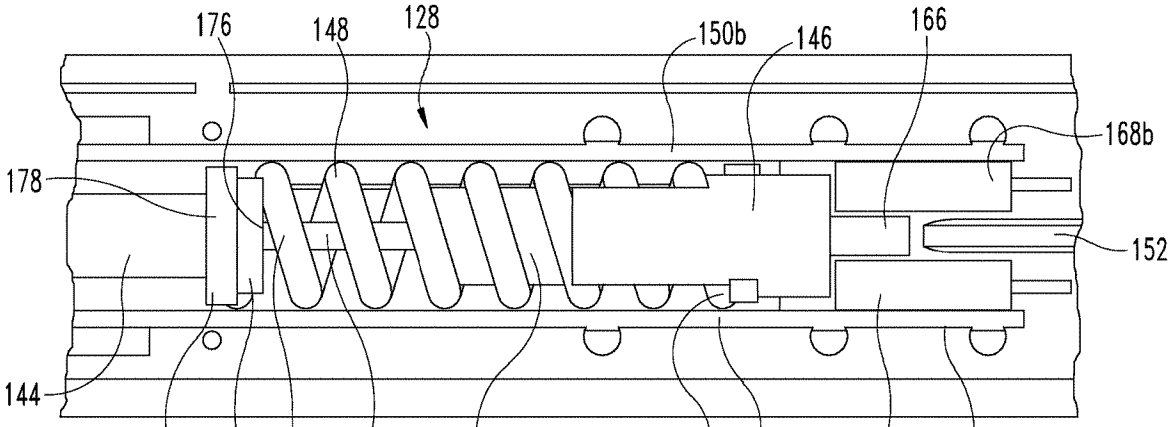
FIG. 7 illustrates a front view of a portion of the baseplate assembly shown in FIG. 5.

As shown in FIGS. 5 and 6, according to certain embodiments, the bell cranks 130*a*, 130*b* may include a cover 142 that may be directly or indirectly in contact with an inner portion of the push bar 104. At least one of the biasing elements 134 may assist in at least biasing the bell cranks 130*a*, 130*b* to a first, uncompressed position, as discussed below. Additionally, according to certain embodiments, one or more of the biasing elements 134 may bias the positioning of other components of the exit device 100 that may be operably coupled to the baseplate assembly 124 to deactivated positions. For example, according to certain embodiments, at least one biasing element 134 may bias at least the position of a shock shaft 144 of the baseplate assembly 124 that extends from the second end 138 of the baseplate 126, the shock shaft 144 being operably coupled to an ancillary component of the exit device 100, such as, for example, an electric latch retraction assembly.

According to the illustrated embodiment, the damper device 128 may include a spring damper element 146, a damper biasing element 148, and a control linkage element 150. The control linkage element 150 may operably couple at least one bell crank 130*a* to the latch assembly 118. For example, referencing FIGS. 5-10, the control linkage element 150 may be two control linkage elements 150*a*, 150*b* that extend from opposing sides of the bell crank 130*a* to at least a connection link 152 of the latch assembly 118. According to certain embodiments, each of the control linkage elements 150*a*, 150*b* may include a first end 154 and a second end 156, the second end 156 having an aperture 158 that is configured to receive the slideable placement of a protrusion 160 that extends from one or both sides 161 of the bell crank 130*a*. In the illustrated embodiment, the aperture 158 may have a generally elongated slot configuration. The first end 154 of the control linkage elements 150*a*, 150*b* may have one or more orifices 162*a*, 162*b* that coupled to the control linkage elements 150*a*, 150*b* to the spring damper element 146 and/or the latch assembly 118. For example, according to the illustrated embodiment, the first end 154 of the control linkage elements 150*a*, 150*b* have a first orifice 162*a* that is sized to receive the insertion of a mechanical fastener, such as, a pin, screw, bolt, or rivet, among other fasteners, that also passes through an orifice of a connector portion 166 of the spring damper element 146. Similarly, according to the illustrated embodiment, the first end 154 of the control linkage elements 150*a*, 150*b* may have a second orifice 162*b* that is sized to receive the insertion of a mechanical fastener that passes through an orifice 164 in a connection link 152 of the latch assembly 118.

In the illustrated embodiment, the damper device 128 may also include one or more positioning elements 168*a*, 168*b* that may at least assist in operably securing the control linkage elements 150*a*, 150*b* to the spring damper element 146 and/or the connection link 152 of the latch assembly 118. For example, in the illustrated embodiment, positioning elements 168*a*, 168*b* may be positioned between the control linkage elements 150*a*, 150*b* and on opposing sides of the connector portion 166 of the spring damper element 146 and/or the connection link 152 of the latch assembly 118. Further, according to the illustrated embodiments, the positioning elements 168*a*, 168*b* may include one or more orifices that are generally aligned with at least the first and second orifices 162*a*, 162*b* of the control linkage elements 150*a*, 150*b* such that the mechanical fasteners that pass through the first and second orifices 162*a*, 162*b* of the control linkage elements 150*a*, 150*b* also are received in associated orifices in the positioning elements 168*a*, 168*b*. However, according to other embodiments, the control linkage elements 150*a*, 150*b*, the spring damper element 146, and/or the connection link 152 may be sized or otherwise configured to eliminate the use of either, or both, of the positioning elements 168*a*, 168*b*.

The spring damper element 146 is configured to provide at least some resistance to prevent or otherwise minimize independent movement of the latch assembly 118 relative to the baseplate assembly 124 when the entryway device 102 is subjected to high velocity impact forces, as discussed below. A variety of different types of dampers maybe used for the spring damper element 146, including, for example, hydraulic or mechanical dampers. Further, the spring damper element 146 may include a body portion 170, which may include, or from which may extend, the connector portion 166.

An action rod 172 may extend from the body portion 170 of the spring damper element 146 and be operably coupled to a shock shaft 144 of the baseplate assembly 124. According to the illustrated embodiment, the action rod 172 may be operably coupled to the shock shaft 144 such that displacement of the shock shaft 144 may be translated into displacement of the action rod 172. For example, according to the illustrated embodiment, the shock shaft 144 is coupled to the action rod 172 by a flange 174. First and second ends 176, 178 of the flange 174 may be operably connected to the shock shaft 144 and the action rod 172, respectively, in a variety of different manners, including, for example, via a press fit, threaded connection, adhesive, weld and/or a mechanical fastener, as well as any combination thereof.

The damper biasing element 148 may be configured to at least assist in biasing the spring damper element 146 to a first, un-activated position, as shown, for example, in FIGS.

6 and 8. According to the illustrated embodiment, the damper biasing element 148 is a spring having a first end 180 and a second end 182. Further, as shown in at least FIG. 7, at least a portion of the first end 180 of the spring damper element 146 may be positioned about at least a portion of the body portion 170 of the spring damper element 146, while a second end 182 of the spring damper element 146 may abut against a shoulder 184 of the flange 174.

Figure 8:
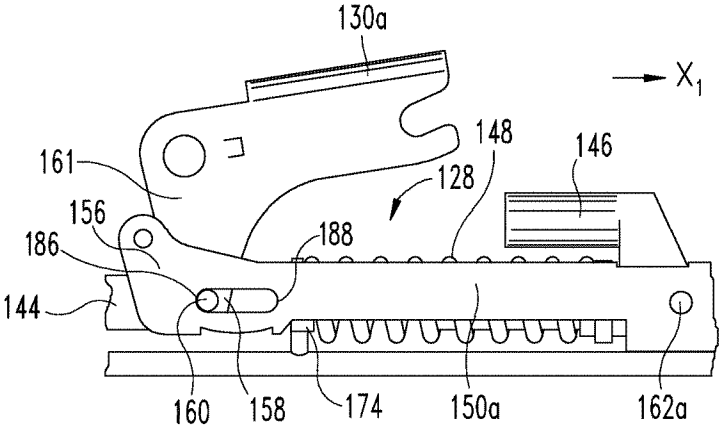
FIG. 8 illustrates a top view of a portion of a baseplate assembly in a rest position according to an illustrated embodiment of the present invention.

Referencing FIGS. 6 and 8, typically, during normal operating conditions, when the exit device 100 is not activated, such as when the push bar 104 has not been displaced toward the mechanism case 106, the bell cranks 130*a*, 130*b* are in a first, uncompressed position. When in the first, uncompressed position, the latch 120 may extend from the latch assembly 118 so as to lock a closed entryway device 102 in the closed position. Further, according to certain embodiments, the biasing elements 134 may exert a force that biases the bell cranks 130*a*, 130*b* to the first, uncompressed position. Additionally, according to certain embodiments, as shown by at least FIG. 8, such biasing forces by at least the biasing elements 134 may cause a first portion 186 of the aperture 158 of the control linkage elements 150*a*, 150*b* to exert a pulling force against the protrusion 160 of the bell crank 130*a* in a first direction generally toward the latch assembly 118, as indicated by direction $x_1$ in FIG. 8. Such biasing force via the control linkage elements 150*a*, 150*b* may assist in pivotally displacing the bell cranks 130*a*, 130*b* to, and/or maintaining the bell cranks 130*a*, 130*b* at, the first, uncompressed position.

Figure 9:
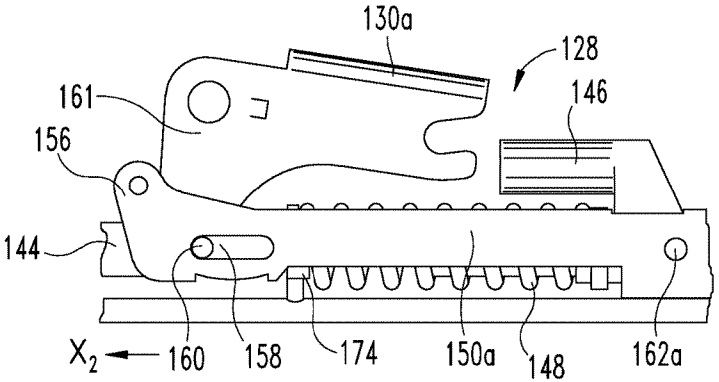
FIG. 9 illustrates a top view of a portion of the baseplate assembly shown in FIG. 8 in an activated position.

Generally during normal operation, when the exit device 100 is to be activated, the push bar 104 is typically displaced or compressed toward the mechanism case 106. Such displacement of the push bar 104 may facilitate the pivotal displacement of the bell cranks 130*a*, 130*b*, from the first, uncompressed position to a second, compressed position, as shown for example by the bell crank 130*a* depicted in FIG. 9. Such pivotal displacement of the bell crank 130*a* may cause the protrusion 160 of the bell crank 130*a* to be displaced from a first position, as shown in FIG. 8, toward a second position, as shown in FIG. 9. Moreover, activation of the push bar 104, and associated pivotal displacement of the bell crank 130*a* may result in the protrusion 160 being displaced in a second direction generally away from the latch assembly 118, as indicated by arrow $x_2$ in FIG. 9. Such, the displacement of the protrusion 160 may exert a pushing force against a first side portion 186 of the aperture 158 of the control linkage elements 150*a*, 150*b* that overcomes the biasing force of the damper biasing element 148, and thereby displace at least the control linkage elements 150*a*, 150*b* in the second direction (as indicated by direction $x_2$ in FIG. 9).

Additionally, as the control linkage elements 150*a*, 150*b* are operably connected to the connector portion 166 of the spring damper element 146 and/or the connection link 152 of the latch assembly 118, the displacement of the control linkage elements 150*a*, 150*b* may also displace the spring damper element 146 and/or the connection link 152 generally in the second direction. Such displacement of the connection link 152 of the latch assembly 118 may facilitate the displacement of the latch 120 from the locked position to an unlocked position. Additionally, such displacement of the spring damper element 146 with the control linkage elements 150*a*, 150*b* may prevent, or otherwise minimize, activation of the spring damper element 146, thereby allowing the damping effect of the spring damper element 146 to be generally by-passed when the exit device 100 is activated. Further, lost motion built into the exit device 100 may generally minimize the impact the spring damper element 146 has on general usage of the exit device 100. Additionally, given the relatively low velocity nature of both typical operation of the exit device 100 via displacement of the push bar 104, as well as the relatively low velocity nature of the spring damper element 146, the spring damper element 146 may provide relatively minimal, if any resistance to such displacement of at least the control linkage elements 150*a*, 150*b*. Accordingly, generally during typical everyday usage of exit device 100, the inclusion of the spring damper element 146 may have minimal, if any, adverse impact on the force needed to operate the exit device 100, and more specifically, to displace the latch 120 from the locked position to the unlocked position.

Figure 10:
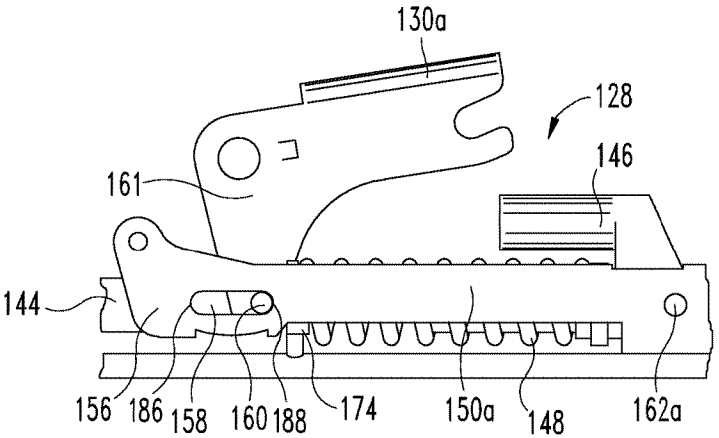
FIG. 10 illustrates a top view of a portion of the baseplate assembly shown in FIG. 8 in which the centercase assembly has at least attempted to move independently of the baseplate assembly.

FIG. 10 illustrates the baseplate assembly 124 in a scenario in which the entryway device 102 has been subjected to a relatively large impact force. For example, FIG. 10 provides an example of a situation in which the entryway device 102 has been impacted by an object at a relatively high velocity, such as, for example, at a velocity associated with hurricane conditions and/or large missile impact testing. Such impact on the entryway device 102 may impart a relatively large relative velocity into the exit device 100 between at least a portion of the latch assembly 118 and the baseplate assembly 124. For example, in the embodiment illustrated in FIG. 10, such impact may cause at least the connection link 152 of the latch assembly 118 to move, at a relatively high velocity, generally in the second direction (direction $x_2$ in FIG. 9) toward the baseplate assembly 124. However, the spring damper element 146 is adapted to resist such high velocity movement of the latch assembly 118, and in particular, such high velocity movement of the latch assembly 118 independent of the movement baseplate assembly 124. Thus, the spring damper element 146 is adapted to provide a relatively large resistant to such high velocity movement of at least the latch assembly 118 relative to the baseplate assembly 124. Moreover, the spring damper element 146 provides a relatively large resistance that generally prevents the latch assembly 118 from moving independently of the baseplate assembly 124, and thereby forces the latch assembly 118 and the baseplate assembly 124 to move together. Further, as shown in FIG. 10, the generally elongated slot configuration of the aperture 158 may be sized so the protrusion 160 of the bell crank 130*a* does not engage a second portion 188 of the aperture 158 of the control linkage elements 150*a*, 150*b* as the spring damper element 146 is compressed by the relatively high velocity movement of the latch assembly 118, the first and second side portions 186, 188 being positioned on opposing sides of the aperture 158. Such sizing of the aperture 158 may prevent the control linkage elements 150*a*, 150*b* from pushing the associated protrusion 160 of the bell crank 130*a* in the second direction so as to at least assist in preventing displacing the bell crank 130*a* from the first, uncompressed position, to the second, compressed position. Moreover, such resistance provided by the spring damper element 146 to relative high velocity movement between the latch assembly 118 and the baseplate assembly 124 may at least attempt to prevent activation of the exit device 100 and/or unlatching of the latch 120 during at least certain conditions, including when the entryway device 102 is subjected to relatively high impact forces.

Various features and advantages of the present invention are set forth in the following claims. Additionally, changes and modifications to the described embodiments described herein will be apparent to those skilled in the art, and such changes and modifications can be made without departing from the spirit and scope of the present invention and without diminishing its intended advantages. While the present invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An exit device comprising:

a latch assembly having a connection link and a latch, the connection link coupled to the latch, the connection link adapted to facilitate displacement of the latch from a locked position to an unlocked position; and a baseplate assembly having at least one bell crank, a control linkage element, and a spring damper element, the at least one bell crank configured for pivotal displacement from a first, uncompressed position to a second, compressed position, the control linkage element having a first end and a second end, the first end of the control linkage element coupled to the connection link, the second end of the control linkage element having an aperture sized to receive placement of a protrusion of the at least one bell crank, the spring damper element directly fastened to the first end of the control linkage element, the baseplate assembly structured to (1) substantially bypass a resistance force of the spring damper element as the at least one bell crank is pivotally displaced to the second, compressed position and the latch is displaced to the unlocked position at least when the baseplate assembly is subjected to a first velocity movement, and (2) prevent, via at least the resistance force of the spring damper element, movement of the connection link independent of movement of the at least one bell crank at least when the baseplate assembly is subjected to a second velocity movement, the second velocity movement being greater than the first velocity movement.

2. The exit device of claim 1, wherein the protrusion is configured to be displaced from a first position to a second position by the displacement of one or more of the at least one bell crank from the first, uncompressed, position to the second, compressed position, and wherein the displacement of the protrusion toward the second position exerts a pull force on a first side portion of the aperture to displace the control linkage element in a direction generally away from the latch assembly.

3. The exit device of claim 2, further including a damper biasing element adapted to bias at least the spring damper element toward the latch assembly.

4. The exit device of claim 3, wherein the damper biasing element is a spring having a first end and a second end, the first end of the biasing element positioned to abut against a body portion of the spring damper element, the second end of the biasing element positioned to abut against a flange positioned adjacent to an end of a shock shaft of the spring damper element.

5. The exit device of claim 3, wherein the displacement of the control linkage element in the direction generally away from the latch assembly displaces the connection link to facilitate the displacement of the latch from the locked position to the unlocked position.

6. The exit device of claim 1, wherein the control linkage element comprises a first control linkage element and a second control linkage element, the first control linkage element positioned adjacent to a first side of the at least one bell crank, the second control linkage element positioned adjacent to a second side of the at least one bell crank.

7. A baseplate assembly comprising:

a baseplate having a first end and a second end;

a bell crank pivotally coupled to the baseplate, the bell crank having a first side having a protrusion;

a control linkage element having a first end and a second end, the first end of the control linkage element being structured to be coupled to a connection link of a latch assembly, the second end of the control linkage element having an aperture configured to receive the protrusion; and a spring damper element directly fastened to the control linkage element, the spring damper element configured to provide a resistance force to resist high velocity movement of the connection link independent of movement of the bell crank, the spring damper including an action rod that is connected to a shock shaft such that a displacement of the shock shaft is translated to a displacement of the action rod, wherein the baseplate assembly is structured to (1) substantially bypass the resistance force of the spring damper element as the bell crank is pivotally displaced to a compressed position and the control linkage element is linearly displaced to an unlocked position when the baseplate assembly is subjected to a first velocity movement, and (2) prevent, via at least the resistance force of the spring damper element, both pivotal displacement of the bell crank to the compressed position and linear displacement of the control linkage element to the unlocked position when the baseplate assembly is subjected to a second velocity movement, the second velocity movement being greater than the first velocity movement.

8. The baseplate assembly of claim 7, wherein the protrusion is configured to be displaced from a first position to a second position by the pivotal displacement of the bell crank, and wherein the displacement of the protrusion toward the second position exerts a pull force on a first side portion of the aperture to displace the control linkage element generally away from the latch assembly.

9. The baseplate assembly of claim 8, further including a damper biasing element adapted to bias at least the spring damper element toward the latch assembly.

10. The baseplate assembly of claim 9, wherein the damper biasing element is a spring having a first end and a second end, the first end of the spring positioned to abut against a body portion of the spring damper element, the second end of the spring positioned to abut against a flange that is adjacent to an end of the shock shaft of the spring damper element.

11. The baseplate assembly of claim 10, wherein at least a portion of the baseplate assembly is positioned within an interior portion of a mechanism case of an exit device.

12. The baseplate assembly of claim 11, wherein the aperture has a second side portion that is generally positioned on a side of the aperture that opposes the first side portion, the first side portion configured to be engaged by the protrusion, the second side portion spaced away from the first side portion by a length that prevents the protrusion from contacting the second side portion.

13. The baseplate assembly of claim 11, wherein the spring damper element is coupled to the control linkage element by a fastener that is inserted through the control linkage element and into a connector portion of the spring damper element.

14. A baseplate assembly comprising:

a baseplate having a first end and a second end;

a bell crank having a first side and a second side, the first side pivotally coupled to a first side plate, the first side having a first protrusion, the second side pivotally coupled to a second side plate, the second side having a second protrusion, the first side plate and the second side plate coupled to the baseplate;

a first control linkage element having a first end and a second end, the first end of the first control linkage element having a first aperture configured to be coupled to a connection link of a latch assembly, the second end of the first control linkage element having a second aperture configured to receive slideable displacement of the first protrusion;

a second control linkage element having a first end and a second end, the first end of the second control linkage element having a first aperture configured to be coupled to the connection link of the latch assembly, the second end of the second control linkage element having a second aperture configured to receive slideable displacement of the second protrusion; and a spring damper element directly fastened to the first control linkage element and the second control linkage element, the spring damper element configured to provide a resistance force to resist high velocity movement of the connection link independent of movement of the latch assembly, wherein the baseplate assembly is structured to (1) substantially bypass the resistance force of the spring damper element as the bell crank is pivotally displaced to a compressed position and the first control linkage element and the second control linkage element are linearly displaced to an unlocked position when the baseplate assembly is subjected to a first velocity movement, and (2) prevent, via at least the resistance force of the spring damper element, both pivotal displacement of the bell crank to the compressed position and linear displacement of the first control linkage element and the second control linkage element to the unlocked position when the baseplate assembly is subjected to a second velocity movement, the second velocity movement being greater than the first velocity movement.

15. The baseplate assembly of claim 14, wherein the first protrusion and the second protrusion are each configured to be displaced from a first position to a second position by the pivotal displacement of the bell crank from an uncompressed position to the compressed position, and wherein the displacement of the first protrusion toward the second position exerts a pull force on the first control linkage element to displace the first control linkage element away from the latch assembly, and the displacement of the second protrusion toward the second position exerts a pull force on the second control linkage element to displace the second control linkage element away from the latch assembly.

16. The baseplate assembly of claim 15, further including a damper biasing element adapted to bias at least the spring damper element toward the latch assembly.

17. The baseplate assembly of claim 16, wherein the damper biasing element is a spring having a first end and a second end, the first end of the spring positioned to abut against a body portion of the spring damper element, the second end of the spring positioned to abut against a flange that is adjacent to an end of a shock shaft of the spring damper element.

18. The baseplate assembly of claim 16, wherein at least a portion of the baseplate assembly is positioned within an interior portion of a mechanism case of an exit device.

19. The baseplate assembly of claim 18, wherein the spring damper element is coupled to the first control linkage element and the second control linkage element by a fastener that is inserted into at least a third aperture of the first control linkage element, a connector portion of the spring damper element, and a third aperture of the second control linkage element.

20. The baseplate assembly of claim 19, wherein the first control linkage element and the second control linkage element are adapted to be displaced a distance sufficient to facilitate displacement of the connection link to displace the latch assembly from a locked position to an unlocked position.

* * * * *